US007954642B2

(12) United States Patent
Jody et al.

(10) Patent No.: US 7,954,642 B2
(45) Date of Patent: Jun. 7, 2011

(54) PROCESS AND APPARATUS FOR SEPARATING SOLID MIXTURES

(75) Inventors: Bassam J. Jody, Tinley Park, IL (US); Jeffrey S. Spangenberger, Plainfield, IL (US); Joseph A. Pomykala, Jr., Shorewood, IL (US); Edwards J. Daniels, Orland Park, IL (US); Scott T. Lockwood, Joilet, IL (US)

(73) Assignee: U Chicago Argonne, LLC, Chicago, IL (US)

( * ) Notice: Subject to any disclaimer, the term of this patent is extended or adjusted under 35 U.S.C. 154(b) by 30 days.

(21) Appl. No.: 12/563,816

(22) Filed: Sep. 21, 2009

(65) Prior Publication Data

US 2010/0078363 A1 Apr. 1, 2010

Related U.S. Application Data

(60) Provisional application No. 61/100,684, filed on Sep. 26, 2008.

(51) Int. Cl.
*B03B 5/62* (2006.01)

(52) U.S. Cl. ..... 209/158; 209/159

(58) Field of Classification Search ..... 209/158, 209/159, 162, 172, 173, 192, 730, 731
See application file for complete search history.

(56) References Cited

U.S. PATENT DOCUMENTS 2,074,977 A * 3/1937 Bird et al. ..... 209/155
2,683,685 A * 7/1954 Matheson ..... 208/152
2,708,517 A * 5/1955 Evans ..... 209/158
2,743,814 A * 5/1956 Berg ..... 209/132
2,754,966 A * 7/1956 Kollgaard et al. ..... 209/139.1
2,779,719 A * 1/1957 Spitz et al. ..... 208/127
2,952,356 A * 9/1960 Dunlop et al. ..... 209/136
3,228,872 A * 1/1966 Metrailer ..... 208/127
3,550,773 A * 12/1970 Klibanoff et al. ..... 209/138
3,627,129 A * 12/1971 Hartmann et al. ..... 209/474
3,700,102 A * 10/1972 Higgins ..... 209/158
4,173,530 A 11/1979 Smith et al.
4,253,942 A 3/1981 Gaumann
4,314,899 A * 2/1982 Styring, Jr. ..... 208/411
4,416,764 A * 11/1983 Gikis et al. ..... 208/390
4,554,066 A * 11/1985 Turbitt et al. ..... 209/3
4,746,421 A * 5/1988 Turbitt ..... 209/3
4,784,757 A 11/1988 Nelson et al.
4,807,761 A * 2/1989 Hollingsworth ..... 209/158
4,913,803 A * 4/1990 Earls et al. ..... 209/17
4,913,807 A * 4/1990 Hendricks ..... 209/461
4,961,842 A * 10/1990 Schulz et al. ..... 209/155
4,961,843 A 10/1990 Lewis (Continued)

*Primary Examiner* — Stefanos Karmis
*Assistant Examiner* — Brett C Martin
(74) *Attorney, Agent, or Firm* — Joan Pennington

(57) ABSTRACT

An elutriation column is installed in a separation tank. The elutriation column includes a vertical separation column having a first side feed arm and a second side overflow arm spaced above the first side feed arm. Water is forced upwardly through the vertical separation column at a controllable velocity. A solid feed mixture is fed through the first side feed arm to the vertical separation column. Water from the tank rising in the vertical separation column at the controlled velocity causes targeted floater materials to move upwardly in the vertical separation column and heavier sinker materials to continue to sink. The floater materials flow from an outlet in the side of the separation tank into the recovery tank. At a discharge, lower end of the vertical separation column, the heavier sinker materials are removed from the separation tank. A mechanism is provided for purging undesirable materials that can cause plugging from the feed arm.

21 Claims, 3 Drawing Sheets

U.S. PATENT DOCUMENTS

| | | | | |
|---|---|---|---|---|
| 5,653,867 | A | 8/1997 | Jody et al. | |
| 5,769,238 | A | 6/1998 | Gupta | |
| 5,894,996 | A | 4/1999 | Williams | |
| 6,164,456 | A * | 12/2000 | Smucker et al. | 209/164 |
| 6,329,436 | B1 | 12/2001 | Jody et al. | |
| 6,599,950 | B2 | 7/2003 | Jody et al. | |
| 7,090,082 | B2 * | 8/2006 | Stahl et al. | 209/156 |
| 7,255,233 | B2 | 8/2007 | Daniels et al. | |
| 7,404,492 | B2 * | 7/2008 | Kucher et al. | 209/730 |
| 2005/0061715 | A1 * | 3/2005 | Wolfgang | 209/158 |
| 2005/0072739 | A1 | 4/2005 | Curlee et al. | |
| 2006/0243646 | A1 * | 11/2006 | Kucher et al. | 209/730 |
| 2007/0231480 | A1 * | 10/2007 | Yasui | 427/212 |

* cited by examiner

PROCESS AND APPARATUS FOR SEPARATING SOLID MIXTURES

This application claims the benefit of U.S. Provisional Application No. 61/100,684 filed on Sep. 26, 2008.

CONTRACTUAL ORIGIN OF THE INVENTION

The United States Government has rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

The present invention relates to a process and apparatus for separating solid mixtures.

DESCRIPTION OF THE RELATED ART

The separation of solids mixtures, such as mixtures of plastics, metals or other solid chip-sized materials such as polymer mixtures derived from shredder residue is important so that valuable materials can be recovered and recycled, and residual materials can be recovered and disposed of in an environmentally safe manner.

Recycling of different types of polymers has increased in recent years. Processes for separating different polymer types have become increasingly important. Separation of solids using differences in their densities is a simple, economical and effective technique. A liquid whose density is between the densities of two solids can be used as the working medium. The solid with the lesser density floats and the solid with the higher density sinks resulting in the separation of the mixture. However, materials that have similar or overlapping densities, acrylonitrile butadiene styrene, ABS, and high impact polystyrene, HIPS, cannot be separated in acceptably high purities by this simple and inexpensive technique. Similarly, wood and various types of rubber materials that are generally found as contaminants in post consumer or post manufacturing waste plastics, have densities that overlap with the densities of the plastics and therefore can not be separated by this technique.

Various techniques are known for separating mixed plastics, for example, using gravity separation and froth flotation techniques. The present inventors have provided improvements over the prior art having previously developed effective technologies for separating mixed plastics, for example, using gravity separation and froth flotation techniques, and received U.S. Pat. Nos. 6,599,950; 5,653,867; 6,329,436; and 7,255,233.

U.S. Pat. No. 7,255,233 to Edward J. Daniels, Bassam J. Jody, Joseph A. Pomykala Jr., issued Aug. 14, 2007, and assigned to the present assignee, discloses a method and apparatus for separating mixed plastics using flotation techniques including a first stage initial washing tank for washing of incoming plastics and providing a first separation process and at least one separation module. The first stage initial washing tank includes a perforated basket to hold heavy materials, such as metals, glass, and the like. Each separation module includes a separation tank, a feeding section for feeding of mixed stream into the separation tank; and a collecting section for collecting of the separated mixed plastics including floaters and sinkers from the separation tank. The separation tank has no moving parts. Each separation tank and the first stage initial washing tank is a standard off-the-shelf circular tank with a flat bottom. Washing and drying steps are eliminated between separation stages. Batch processing is replaced with generally continuous operation. An integrated vibrating screen or air classification system is provided.

U.S. Pat. No. 6,599,950 to Bassam J. Jody et al. issued Jul. 29, 2003, and assigned to the present assignee, discloses a method of separating a portion of acrylonitrile-butadiene-styrene (ABS) from a mixture containing ABS and for separating a portion of ABS and polycarbonate (PC) from a mixture of plastics containing ABS and PC. The method includes shredding and/or granulating the mixture of plastics containing ABS and PC to provide a selected particle size; sequentially dispersing the shredded mixture of plastics in a series of aqueous solutions having different specific gravities and separating the floating fraction until the desired separation is obtained. Surface tension and pH are also variables to be controlled.

U.S. Pat. No. 6,329,436 to Bassam J. Jody et al. issued Dec. 11, 2001, and assigned to the present assignee, discloses a system and process for recycling shredder residue, in which any polyurethane foam materials are first separated. Then separate a fines fraction of less than about ¼ inch leaving a plastics-rich fraction. Thereafter, the plastics rich fraction is sequentially contacted with a series of solvents beginning with one or more of hexane or an alcohol to remove automotive fluids; acetone to remove ABS; one or more of EDC, THF or a ketone having a boiling point of not greater than about 125° C. to remove PVC; and one or more of xylene or toluene to remove polypropylene and polyethylene. The solvents are recovered and recycled.

U.S. Pat. No. 5,653,867 to Bassam J. Jody et al. issued Aug. 5, 1997, and assigned to the present assignee, discloses a method of separating acrylonitrile butadiene styrene (ABS) and high impact polystyrene (HIPS) plastics from each other. The ABS and HIPS plastics are shredded to provide a selected particle size. The shredded particles of the ABS and HIPS plastics are applied to a solution having a solution density in a predefined range between 1.055 gm/cm.sup.3 and 1.07 gm/cm.sup.3, a predefined surface tension in a range between 22 dynes/cm to 40 dynes/cm and a pH in the range of 1.77 and 2.05. In accordance with a feature of the invention, the novel method is provided for separating ABS and HIPS, two solid thermoplastics which have similar densities by selectively modifying the effective density of the HIPS using a binary solution with the appropriate properties, such as pH, density and surface tension, such as a solution of acetic acid and water or a quaternary solution having the appropriate density, surface tension, and pH.

The above-identified patents provide significantly improvements over prior art arrangements, providing basic separation processes involving selective flotation or sinking of the targeted polymer away from the mixture so that it can be collected at a higher purity. The sink float separation occurs in a solution that has pre-determined specific gravity, pH and surface tension. These solution parameters are maintained by the addition of salts, acids or bases and surfactants to the water. Therefore, the processed materials required rinsing to remove these chemicals. This increases the cost of the process equipment and results in the production of substantial amounts of waste water.

A need exists for a process and apparatus operating in a continuous mode for separating solid mixtures that provides both improved process economics and environmental impact, that enables reducing the amount and cost of required chemicals and minimizing waste water production.

A principal aspect of the present invention is to provide an improved process and apparatus for separating solid mixtures.

A primary aspect of this process is that the need for chemicals for separating solid mixtures is minimized or substantially eliminated.

Other important aspects of the present invention are to provide such process and apparatus for separating solid mixtures substantially without negative effect and that overcome some of the disadvantages of prior art arrangements.

SUMMARY OF THE INVENTION

In brief, an improved process and apparatus are provided for separating solid mixtures. An elutriation column is installed in a separation tank. The elutriation column includes a vertical separation column having a first side feed arm located at a selected height and extending at a selected angle from the vertical separation column. The elutriation column includes a second side overflow arm spaced above the first side feed arm at a selected height and extending at a selected angle from the vertical separation column. Water is forced upwardly through the vertical separation column at a predetermined controlled velocity. A solid feed mixture is fed through the first side feed arm to the vertical separation column. Water from the tank rising in the vertical separation column at the controlled velocity causes lighter floater materials to move upwardly in the vertical separation column and heavier sinker materials to continue to sink. The floater materials flow from an outlet in the side of the separation tank into the recovery tank. At the discharge end of the vertical separation column, the heavier sinker materials are removed from the separation tank using a conveyor such as a screw conveyor.

A recovery tank separates water from the recovered floater materials. The recovered floater materials flow from an outlet in the side of the separation tank into the recovery tank. The recovery tank contains a screen, which catches the recovered floater materials in an upper portion of the recovery tank while the water drains into the lower portion of the recovery tank and is recirculated back to the separation tank. The recovered floater materials are removed from the upper portion of the recovery tank, for example, by an inclined screw conveyer to an appropriate receptacle. The recovered solution is then circulated back to the separation tank.

In accordance with features of the invention, the process minimizes or eliminates the need for salts to alter the specific gravity of the solution. The location of the first side arm relative to the column depends on the composition and types of feed materials in the solid feed mixture. The side feed arm is located at a selected height near the midpoint of the vertical separation tube extending at about a 45-degree angle from the vertical. The actual angle is selected based on the properties of the materials in the mixture that are being fed in order to maintain the flow of the mixture. Feeding part of the returning solution with the mixture in the side arm or at an inward angle at the point where the mixed material leaves the side arm and enters the separation column is necessary for some materials to guard against bridging of the materials in the side arm. Mixtures that contain large portions of materials that have densities lower than the density of the water or the solution used in the separation process and therefore, tend to float in the water or the solution and with no additional external forces tend to start to separate in the side arm and disrupt the flow of the mixture to the column. For such materials the side arm is modified and fitted with an eductor, or other manner of material removal, to separate the floating materials and keep the uniform flow in the side arm toward the separation column. The second side overflow arm is located at a selected height near an upper portion of the vertical separation column near the water level of the flotation tank extending at about a 90-degree angle from the vertical. Sloping of this side arm a few degrees downward helps prevent the floaters from settling in the side arm. This is particularly important when the materials made to float in the separation column are much heavier than the water or the solution used in the separation process. The water optionally contains a surfactant. The solid feed mixture contains, for example, a mixture of polymers, metals, glass, and the like.

In accordance with features of the invention, the separation tank is sloped at the bottom to substantially eliminate dead zones for the sinker materials to lodge and to accommodate a horizontal screw conveyer. The tank is filled with water and which optionally contains a surfactant for some applications. Salts, acids and bases may still be used for instances when surface modification is necessary to achieve the desired separation of equal density materials or when otherwise very high solution flow rates are required such as for example, with very heavy materials.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the invention, an improved process and apparatus are provided for separating solid mixtures. The process minimizes or substantially eliminates the need for chemicals. It should be understood that surfactants may be used for some applications.

A particle will float in a solution if the net force vector acting on the particle is in the upward direction. This can be achieved by a number of ways. One of these ways is to add salts that dissolve in the solution to increase its density so that it exceeds the density of the particle so that the buoyancy force acting upward on the particle exceeds the gravitational force acting downward on the particle.

In accordance with features of the invention, a method advantageously is used to set the water or solution in motion at a velocity that can offset the gravitational force acting on the targeted particles in the water or solution so that targeted particles float while the other particles continue to sink. This process is an elutriation process that is used for separating solid mixtures in accordance with the invention.

Elutriation has been very effectively applied in separating fine solid mineral particles that settle to form a packed bed seal through which water does not leak. The solids are recovered from the bottom of the unit with minimal loss of water using a known cross flow separator.

In accordance with features of the invention, a novel elutriation process is applied for separating large particles especially those that have relatively small differences in densities, such as those encountered in plastics recycling operations, where the sinkers do not form a seal. The larger particles when settled leave considerable void volumes between them. A similar problem is encountered when separating large metal, glass and rock particles from each other. The novel elutriation process and apparatus of the invention operates where the sinkers do not form a seal, while enabling operation in a continuous mode.

Figure 1:
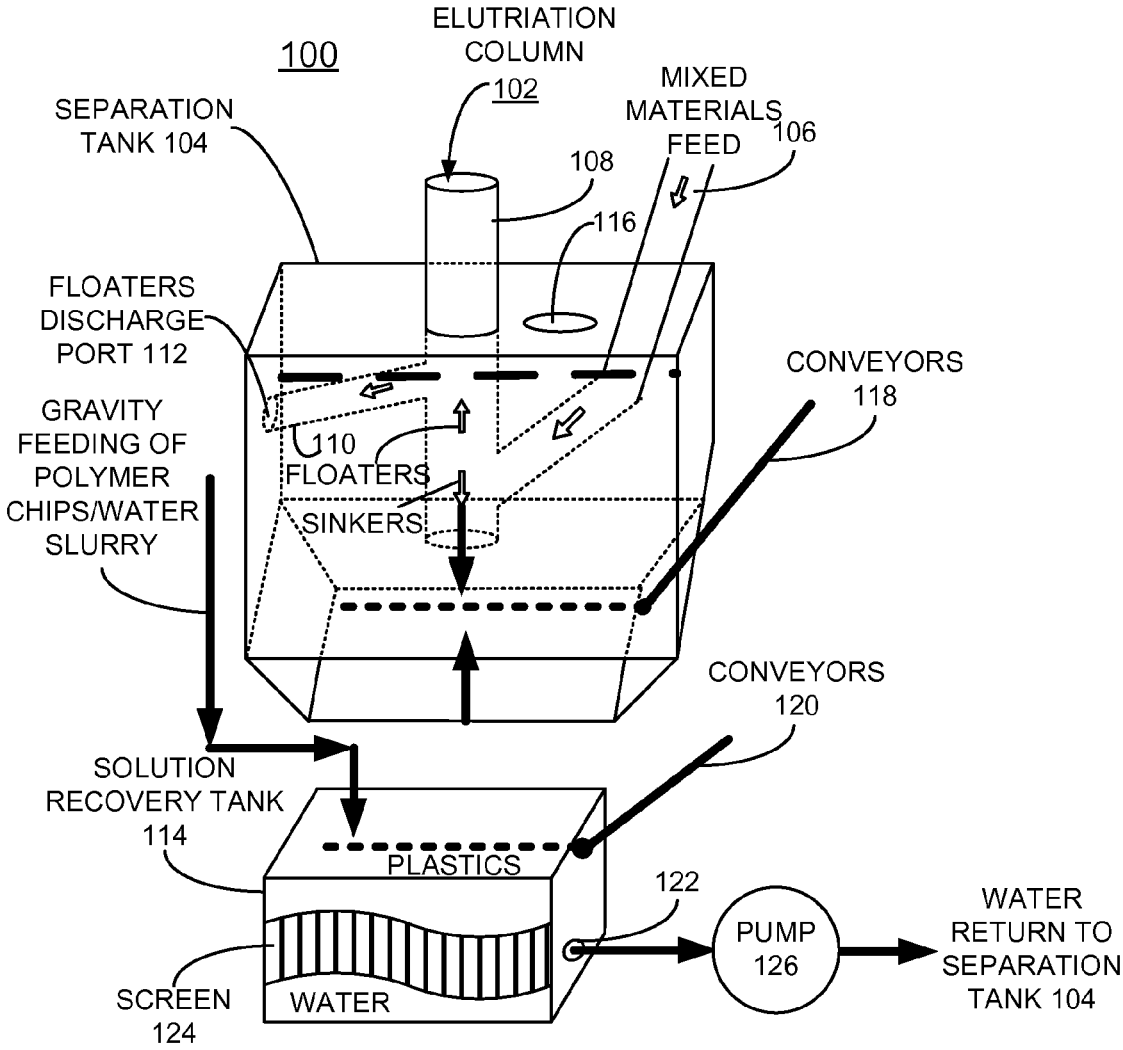
FIG. 1 is a schematic diagram representation illustrating an elutriation separation tank apparatus for separating solid mixtures in accordance with the preferred embodiment.

Having reference now to the drawings, FIG. 1 illustrates an elutriation separation tank apparatus generally designated by the reference character 100 for separating solid mixtures in accordance with the preferred embodiment.

Elutriation separation tank apparatus 100 includes an elutriation column generally designated by the reference character 102 for separating solid mixtures in accordance with the preferred embodiment. The elutriation column 102 is installed in a separation tank generally designated by the reference character 104.

A solid feed mixture of polymers, metals, glass, and the like, is fed through a side arm 106 of the elutriation column 102. The location for the side arm 106 relative to a vertical column 108 of the elutriation column 102 depends on the composition and types of the feed materials. On the average the side arm 106 is located around the midpoint of the vertical column 108. The actual location is determined based on the properties of the materials to be separated so that the column provides enough residence time for both the sinkers to sink and for the floaters to float.

Water or solution indicated by an arrow labeled W from the tank 104 rises in the vertical column 108 of the elutriation column 102 at a predefined rising velocity to cause the targeted materials to move upward in the column 108 and the heavier materials to continue to sink. A pump 126 or other mechanism is used to force the water upwardly in the vertical column 108, as the only outlet for the water, at the predefined rising velocity. The pump delivers the water at the top of the tank and away from the bottom of the column. This eliminates turbulence in the column, which is detrimental to good separation especially when the density gradient between the particles is small such as the case with plastics. Given that the only way for the water to exit the tank is through the elutriation column, the water rises in the column as laminar flow at the pre-determined velocity and with it float the lighter material.

In operation of the elutriation column 102, typically no salts or other chemicals are required. Surfactants to adjust surface tension optionally are used to help in the separation of some species. An arrow labeled FLOATERS indicates targeted materials moving upward in the column 108. An arrow labeled SINKERS indicates heavier materials moving downward in the column 108 that are discharged from a bottom, discharge end of the vertical column 108.

The required rising velocity in the elutriation column 102 is selectively determined and provided depending upon the characteristics of the mixed materials feed including:

a. The composition of the feed stream; and b. The size, shape and weight of the particles in the mixed materials feed.

The floating stream overflows from the elutriation column 102 into a side pipe 110 and out of the tank 104 as indicated at a floaters discharge port 112 from the separation tank 104. Then solids are separated from the water in a recovery tank 114 and then the water is returned to the separation tank 104, preferably at the top of the separation tank 104, such as through a water return port 116 in order to avoid disturbing the settling particles that are being conveyed out of the tank.

Elutriation separation tank apparatus 100 is designed to force the water to leave the tank 104 only through the discharge port 112 from the elutriation column 102. The heavier sinker materials are conveyed out of the separation tank 104 using screw conveyors 118 at the bottom of the tank 104. The recovery tank 114 separates the water from the targeted floater materials or recovered solids.

Using the flotation tank 104 with the elutriation column 102, the heavier sinker materials or sinkers in the column 108 do not have to accumulate at the bottom of the column to form a water seal. The water is allowed to start rising in the column 108 at the bottom of the column rather than at a midpoint in the column 108. This reduces the required height of the elutriation column 102, which reduces the necessary height for the tank and allows the water to rise as a uniform laminar flow with no turbulence in any part of the column. The screw conveyors 118 in the separation tank 104 remove the heavier materials or sinkers as they are generated. Typically, silt generated by shredder residue becomes difficult to remove if it accumulates, which is avoided by the elutriation separation tank apparatus 100.

A screw conveyor 120 at the upper portion of the recovery tank 114 or other mechanism is used to remove the targeted floater materials from the recovery tank 114 to an appropriate receptacle. The recovered water or solution is then circulated back to the separation tank 104. A water discharge port 122 in the recovery tank 114 is located below a screen 124, which catches the targeted floater materials while the water or solution drains into the lower portion of the recovery tank 114. A pump 126 moves the water from water discharge port 122 in the recovery tank 114 to be returned to the separation tank 104.

Elutriation separation tank apparatus 100 advantageously is used to separate a variety of materials by varying only the rising water velocity and possibly the addition of a surfactant when necessary. Retrofitting flotation tanks with elutriation column 102 has enabled separating mixed materials, including polymers and metals, of different particle sizes, by flotation without using salts to increase the specific gravity of the solutions. This resulted in eliminating the need for salts, and the elimination of large quantities of waste water containing salts, elimination of the need for rinse equipment and rinse water for the recovered materials to remove residual salt on the recovered materials, and the cost reduction of the overall system by more than 15%.

In some instances, when material at a lower density than the water or solution in the tank 104, nuisance material will continue to float in the feed side arm 106 at the liquid's level. This nuisance material disrupts the even feed rate of the material when it is allowed to build up.

Figure 2:
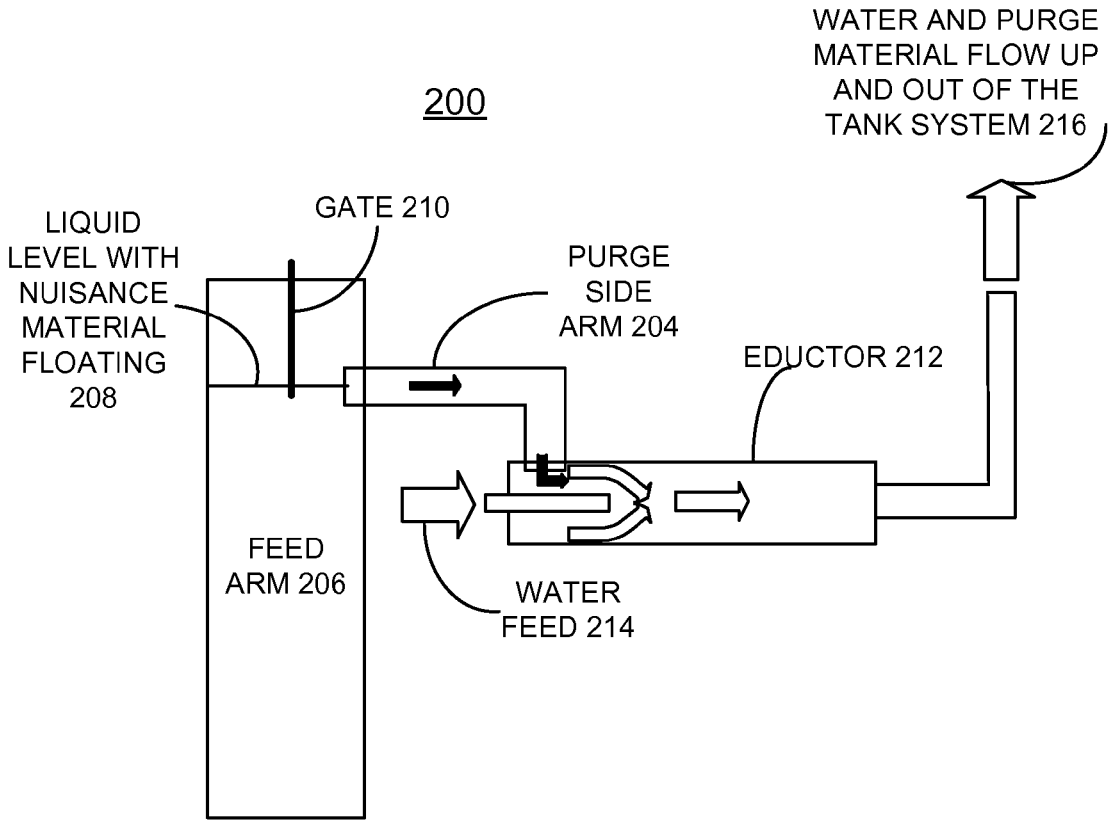
FIG. 2 is a schematic diagram representation illustrating a nuisance purge using an eductor for the elutriation separation tank apparatus of FIG. 1 in accordance with A preferred embodiment.
Figure 3:
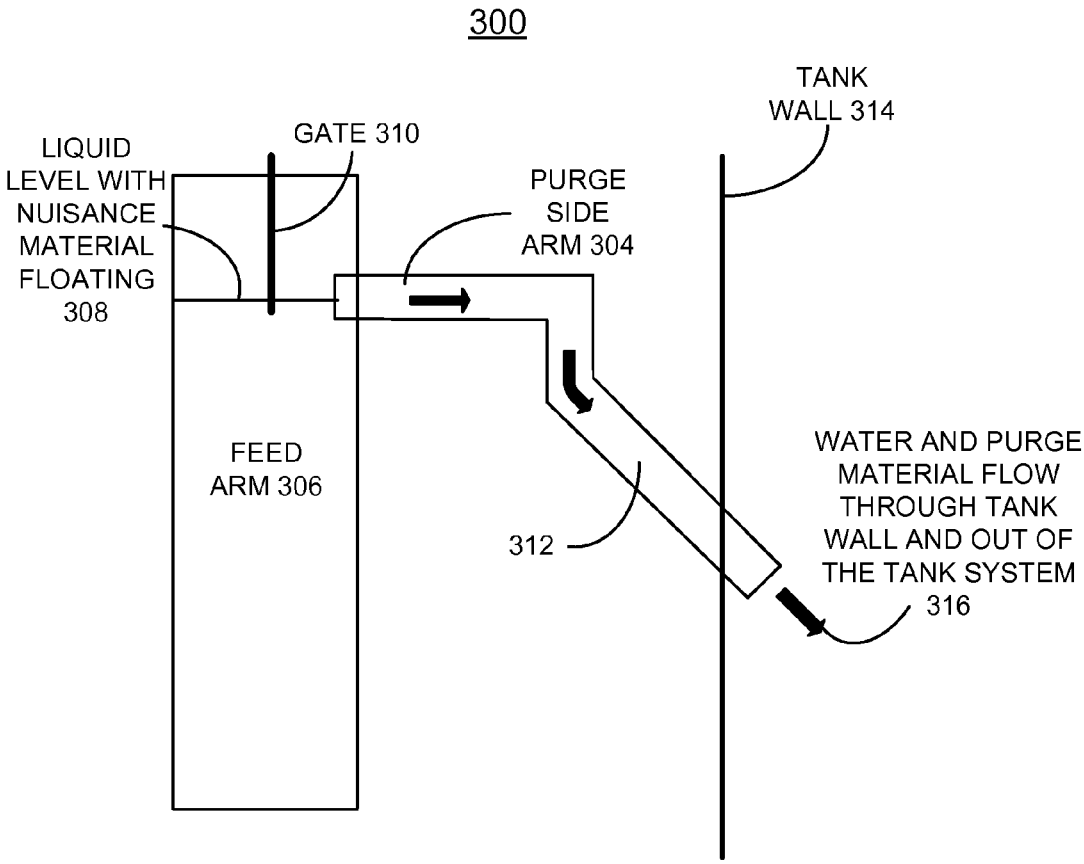
FIG. 3 is a schematic diagram representation illustrating a gravity drain mechanism for the elutriation separation tank apparatus of FIG. 1 in accordance with the preferred embodiment.

Referring also to FIGS. 2 and 3, an eductor arrangement generally designated by the reference character 200 is shown in FIG. 2 and a simple gravity drain arrangement generally designated by the reference character 300 is shown in FIG. 3.

In accordance with features of the invention, the flow out of the feed tube is maintained in a number of ways, but the inventors commonly use two. The first is the use of an eductor and the second is the use of simple gravity.

In accordance with features of the invention, in order to eliminate this problem, an L-shaped purge side arm 204 of eductor arrangement 200, and an L-shaped purge side arm 304 of gravity drain arrangement 300 is added to a feed arm 206, 306 at a height of just below the operating liquid level 208, 308. The floating material is removed by flowing through this feed arm out of the tank. In both arrangements 200, 300 the flow of the water out of the system needs to be accounted for in regard to the fluid velocity in the elutriation column. This can be achieved by adding the same amount of liquid into the respective feed arm 206, 306. In order to eliminate the removal of material that is not intended to be eliminated, the feed material is fed on one side of the feed arm 206, 306 and is kept separated from the purge flow by a respective gate 210, 310 which extends a few inches below the liquid level 206, 308.

In FIG. 2, an eductor 212 coupled to the L-shaped purge side arm 204 and receiving a water feed 214 at a first end, and water and purge material flow up and out of the tank system as indicated at arrow 216. The eductor 212 maintains the flow direction at the purge arm 204 by creating a vacuum in downstream plumbing. This vacuum evacuates the liquid from the purge arm 204.

In FIG. 3, an eductor 212 coupled to the L-shaped purge side arm 204 and receiving a water feed 214 at a first end, and water and purge material flow up and out of the tank system as indicated at arrow 216. The gravity system 300 uses gravity as the force to allow the liquid to evacuate from the purge arm 304 through a discharge conduit 312 extending through a tank wall 314.

Example of a Known Separation Process

The starting feed material to the flotation system is a "polymer concentrate" derived from shredder residue. The starting feed material contains over 2 dozen different polymers, metals, rocks and glass. The particle size is between 2 mm and 12 mm.

To separate specific polymers from the polymer concentrate we floated the polyolefins away from the other two dozen or so polymers in water while using a small amount of surfactant to reduce the surface tension. With the polyolefins some wood and rubber also float. The remaining sinkers are then conveyed to a second flotation tank. The specific gravity in the second tank is maintained at about 1.1 by adding a salt such as sodium chloride (the solution contains about 10% by weight sodium chloride). Polymers including ABS, polystyrene and some PPO and rubber also float. This fraction we labeled as "styrenics." The styrenics fraction is then washed with tap water to remove the salt. This generates waste water and results in the loss of salt. About 0.02 pounds of salt is lost for each pound of plastics that float in the second tank. In addition, about 2-2.5 gallons of waste water containing salts is generated primarily as a result of rinsing the styrenics.

The sinkers from the second stage are sent to a third stage, which is maintained at a higher specific gravity. For example, to recover the metals as a concentrate we had to go to a solution specific gravity of at least 1.5. Higher specific gravities are needed in order to increase the concentration of the metals by floating the denser polymers. This resulted in the metals sinking along with substantial amounts of filled polymers. The metals concentration was in the range of 10%-20% for different samples. The recovered metals had to be processed further to increase their concentration so that they could have a market value. The 1.5 specific gravity was achieved by adding about 6 pounds of potassium carbonate per gallon of water. This increased the process cost. In addition, rinsing the floating polymers to remove the residual salt results in waste water containing high quantities of dissolved solids and therefore require expensive disposal. The metals that sunk in this tank also require rinsing otherwise they will corrode. This generated more waste water. Salt loss in this tank is also excessive (more than 0.2 lb of salt per lb of material entering the tank to be processed).

Example of the New Process of the Invention

The new process achieves the separation using only water and no salts. The use of a surfactant to adjust the surface tension is optional. The new process works as follows to achieve the separations achieved in the above example.

1. To separate polymers recovered from shredder residue we floated the polyolefins away from the other two dozen or so polymers in water using only a small amount of surfactant to reduce the surface tension. With the polyolefins some wood and rubber also float. All equipment and operating conditions are exactly the same as before.
2. The sinkers of the first tank are conveyed to the second tank as before. The second tank is the separation tank 104 fitted with an elutriation column 102, as shown in FIG. 1. The sinkers from stage 1 are fed through the side arm 106 of the elutriation column 102. Water is made to rise in the vertical column 108 at a predetermined rising velocity so that the targeted materials can be selectively floated while other materials continue to sink. The rising water in the column 108 lifts with it the targeted polymers and the overflowing stream of the water and targeted polymers overflow from the column 102 through the side arm 110. The plastics are separated from the overflowing stream and the water is returned to the tank 104. We found that at various rising velocities, a styrenics fraction similar to that recovered in the old salt system can be recovered from the shredder residue plastics. Because of residual polyolefins that should have floated in the first tank but did not the polyolefins are separated in the side arm to minimize disruption of the flow uniformity of the solids mixture in the side arm.
3. The sinkers in stage 2 which contain metals, heavy filled polymers including rubber, rocks and glass are then conveyed to stage 3 which is the same as stage 2 (flotation tank fitted with an elutriation column), except for the rising velocity in the column. By increasing the rising velocity of the water (without using any salt) we floated most of the heavy polymers and the sinkers constituting a metal concentrate that included less other residual heavier materials. The required rising velocity depends on the particle properties and also on the properties of the working fluid used.
4. By increasing the rising velocity in the column further the concentration of metals in the metal concentrate was more than doubled because we were able to float some of the glass and the rocks along with most of the dense polymers. This was accomplished with minimal loss of the metals. This can be done in the same tank/column or in a separate tank/column.

The operation sequence and the operating conditions can be varied for different starting polymer concentrates including those derived from recycling other materials such as electronic and home appliances scrap. The operation sequence and the operating conditions can also be varied to target different plastics and materials for recovery.

Processing of the smaller than 2 mm materials example:

We also processed fines of different particle size distribution derived from shredder residue to recover their metals content. Using only water at various rising water velocities we recovered polymers and metal concentrates. We were able to achieve this using the lower rising water velocity because of the smaller particle size. The rising velocity affects the quality and concentration of sinkers and floaters in any stage. The rising velocity advantageously is controlled to increase the concentration of metals in the sinkers.

While the present invention has been described with reference to the details of the embodiments of the invention shown in the drawing, these details are not intended to limit the scope of the invention as claimed in the appended claims.

What is claimed is:

1. A process for separating solid mixtures comprising the steps of:

installing an elutriation column with a separation tank; said elutriation column including a vertical separation column having a first side feed arm located at a selected height and extending at a selected angle from the vertical separation column and a second side overflow pipe at a selected height spaced above the first side feed arm and extending at a second selected angle from the vertical separation column into a floaters discharge port in the separation tank;

feeding a solid feed mixture through the first side feed arm to the vertical separation column;

forcing water from the separation tank starting at a bottom end of the vertical separation column upwardly through the vertical separation column at a controllable velocity causing targeted floater materials to move upwardly in the vertical separation column and heavier sinker materials to continue to sink;

discharging an overflow stream including targeted floater materials only from the second side overflow pipe into the floaters discharge port from the separation tank into the recovery tank;

discharging the heavier sinker materials from the bottom end of the vertical separation column; and returning water from said recovery tank to the separation tank through a water return port at a top of the separation tank.

2. The process for separating solid mixtures as recited in claim 1 wherein the process substantially reduces the need for chemical additives affecting specific gravity in the water in the separation tank.

3. The process for separating solid mixtures as recited in claim 1 wherein the location of the first side arm relative to the column depends upon the composition and types of feed materials in the solid feed mixture.

4. The process for separating solid mixtures as recited in claim 1 wherein the side feed arm is located at a selected height near the midpoint of the vertical separation tube extending at about a 45 degree angle from the vertical.

5. The process for separating solid mixtures as recited in claim 1 wherein the second side overflow pipe is located at a selected height near an upper portion of the vertical separation tube near the water level of the flotation tank extending at about a 90 degree angle from the vertical.

6. The process for separating solid mixtures as recited in claim 1 includes providing a screw conveyer in a lower portion of the separation tank for removing the sinker materials from the separation tank.

7. The process for separating solid mixtures as recited in claim 1 wherein the separation tank includes sloping sides at a bottom tank portion.

8. The process for separating solid mixtures as recited in claim 1 wherein the separation tank is substantially filled with water.

9. The process for separating solid mixtures as recited in claim 1 wherein said recovery tank separates water from the targeted floater materials in the overflow stream.

10. The process for separating solid mixtures as recited in claim 1 includes providing said recovery tank with a screen, said screen containing the targeted floater materials in an upper portion of the recovery tank and the water draining into a lower portion of the recovery tank.

11. The process for separating solid mixtures as recited in claim 10 includes providing an inclined screw conveyer in the upper portion of the recovery tank for removing the targeted floater materials from the recovery tank.

12. The process for separating solid mixtures as recited in claim 10 includes feeding the recovered water from the recovery tank back to the separation tank.

13. The process for separating solid mixtures as recited in claim 1 including providing a pump, and using said pump for forcing water from the separation tank upwardly through the vertical separation column at a controllable velocity.

14. Apparatus for separating solid mixtures comprising:

a separation tank containing water;

an elutriation column installed in said separation tank; said elutriation column including a vertical separation column having a first side feed arm located at a selected height and extending at a selected angle from the vertical separation column and a second side overflow pipe at a selected height spaced above the first side feed arm and extending at a second selected angle from the vertical separation column into a floaters discharge port in the separation tank;

a solid feed mixture being applied through the first side feed arm to the vertical separation column;

control means forcing water from the separation tank upwardly through the vertical separation column starting at a bottom end of the vertical separation column at a controllable velocity causing targeted floater materials to move upwardly in the vertical separation column and heavier sinker materials to continue to sink;

a recovery tank receiving an overflow stream including targeted floater materials being discharged only from the second side overflow pipe into the floaters discharge port from the separation tank; and the heavier sinker materials being discharged from the bottom end of the vertical separation column; and water from said recovery tank being returned to the separation tank through a water return port at a top of the separation tank.

15. Apparatus for separating solid mixtures as recited in claim 14 wherein said separation tank includes a screw conveyer in a lower portion of said separation tank for removing the sinker materials discharged from the bottom end of the vertical separation column from the separation tank.

16. Apparatus for separating solid mixtures as recited in claim 14 includes a pump, and said pump used for forcing water from the separation tank upwardly through the vertical separation column at a controllable velocity.

17. Apparatus for separating solid mixtures as recited in claim 14 wherein said separation tank includes sloping sides at a bottom tank portion.

18. Apparatus for separating solid mixtures as recited in claim 14 wherein the location of the first side arm relative to the column is selectively provided depending upon a composition and types of feed materials in the solid feed mixture.

19. Apparatus for separating solid mixtures as recited in claim 14 wherein said recovery tank includes a screen, said screen containing the targeted floater materials in an upper portion of the recovery tank and draining water into a lower portion of the recovery tank.

20. Apparatus for separating solid mixtures as recited in claim 19 wherein said recovery tank includes an inclined screw conveyer in the upper portion of the recovery tank for removing the targeted floater materials from the recovery tank.

21. Apparatus for separating solid mixtures as recited in claim 19 including a purge system to remove undesirable materials, said purge system including an eductor coupled to an L-shaped purge side arm, said L-shaped purge side arm coupled to the first side feed arm to remove the undesirable materials from the vertical separation column.

* * * * *